United States Patent [19]

Hake et al.

[11] 3,994,251

[45] Nov. 30, 1976

[54] APPARATUS AND METHOD FOR TRIMMING AND DEBURRING THE EDGES OF CYLINDRICAL METAL BODIES

[75] Inventors: Walter Thomas Hake, Wyckoff; Andrew Halasz, Pompton Plains, both of N.J.

[73] Assignee: American Can Company, Greenwich, Conn.

[22] Filed: Nov. 13, 1975

[21] Appl. No.: 631,513

[52] U.S. Cl. ..... 113/7 R; 82/85; 82/101; 113/120 R

[51] Int. Cl.[2] ..... B21D 51/26

[58] Field of Search ..... 113/7 R, 120 R; 82/57, 82/58, 85, 101

[56] References Cited

UNITED STATES PATENTS

| | | | |
|---|---|---|---|
| 3,581,691 | 6/1971 | Ringler | 113/120 R |
| 3,838,653 | 10/1974 | Larkin et al. | 113/7 R |

*Primary Examiner*—Travis S. McGehee

*Attorney, Agent, or Firm*—Robert P. Auber; Thomas S. Galgano; Ira S. Dorman

[57] ABSTRACT

The trimmed edges of cylindrical metal bodies are freed of internal burrs by shifting the body axially on the support means to move the burr-bearing edge from the cutting element to a cylindrical surface portion, following which an ironing tool flattens the burr against the surface so as to effect its fracture and removal from the body.

9 Claims, 6 Drawing Figures

APPARATUS AND METHOD FOR TRIMMING AND DEBURRING THE EDGES OF CYLINDRICAL METAL BODIES

BACKGROUND OF THE INVENTION

In the manufacture of metal cans and other containers by draw-redraw and drawing and ironing techniques, the container body or shell is formed, with an irregular or uneven edge, which must be removed prior to assembly with the end closure. The trimming apparatus presently employed leaves a sharp burr projecting either inwardly or outwardly of the body, which burr tends to cause jamming and damage to equipment, and interferes with forming apparatus, leading to crack development and ultimate container failure. While machinery for burr removal is available, as exemplified by that shown in U.S. Pat. No 3,581,691, so far as is known none of the existing equipment deals with the removal of internal burrs in an entirely satisfactory and sufficiently simple manner.

Accordingly, it is an object of the present invention to provide a novel method and apparatus for trimming cylindrical metal bodies, and for removing internal burrs which result from the trimming operation.

It is also an object of the invention to provide such a method and apparatus which are simple, efficient and convenient, and are adapted to economical, high-speed operation.

A more specific object is to provide such a method and apparatus which are particularly adapted for the production of container shells by draw-redraw and drawing and ironing techniques and, in particular, for producing such shells from steel and aluminum blanks.

SUMMARY OF THE INVENTION

It has now been found that certain of the foregoing and related objects of the invention are readily attained in an apparatus having support means upon which a cylindrical metal body may be mounted, and including a cutting element and a cylindrical portion. A cutting tool is disposed adjacent the cutting element, and is adapted to cooperate therewith to sever an edge portion of the metal body mounted on the support means, and to form an inwardly-directed burr at the newly-formed edge thereof. An ironing tool is disposed adjacent the cylindrical portion, and is adapted to cooperate therewith to iron a portion of a metal body disposed thereon. The apparatus additionally includes means for shifting the body axially on the support means away from the cutting element so that, following severance and internal burr formation, the burr-bearing portion of the body may be moved onto the cylindrical portion, to permit ironing of the burr thereat and to thereby effect its fracture and removal.

Preferably, the support means is rotatable, and includes a substantially cylindrical mandrel disposed axially adjacent the cylindrical portion thereof. The cylindrical portion advantageously has a relatively sharp edge, which is spaced from the mandrel and which provides the cutting element. Most desirably, the apparatus also includes a rotatable support member, such as a wheel, on which both the cutting tool and also the ironing tool are mounted, at axially- and peripherally-spaced locations.

In a particularly preferred embodiment, the support means is mounted on a first shaft and the rotatable support member is mounted on a second shaft, the shafts being rotatable on substantially parallel axes, and being interconnected to afford synchronized rotation of the support means and support member.

Certain of the objects of the instant invention are attained in a trimming and deburring method which includes, as an initial step, mounting a cylindrical metal body on support means having a cylindrical portion. An edge portion is then severed from the body, so as to form an inwardly-directed burr at the newly-formed edge, after which the body is shifted axially on the support means to move the burr-bearing edge onto the cylindrical portion. Finally, the burr is ironed against the surface of the cylindrical portion to effect its fracture and removal from the remainder of the body. Preferably, the body is rotated while performing the severing and ironing steps, and generally the body will be the shell for a drawn and ironed or draw-redraw container.

DETAILED DESCRIPTION OF THE ILLUSTRATED EMBODIMENT

Figure 1:
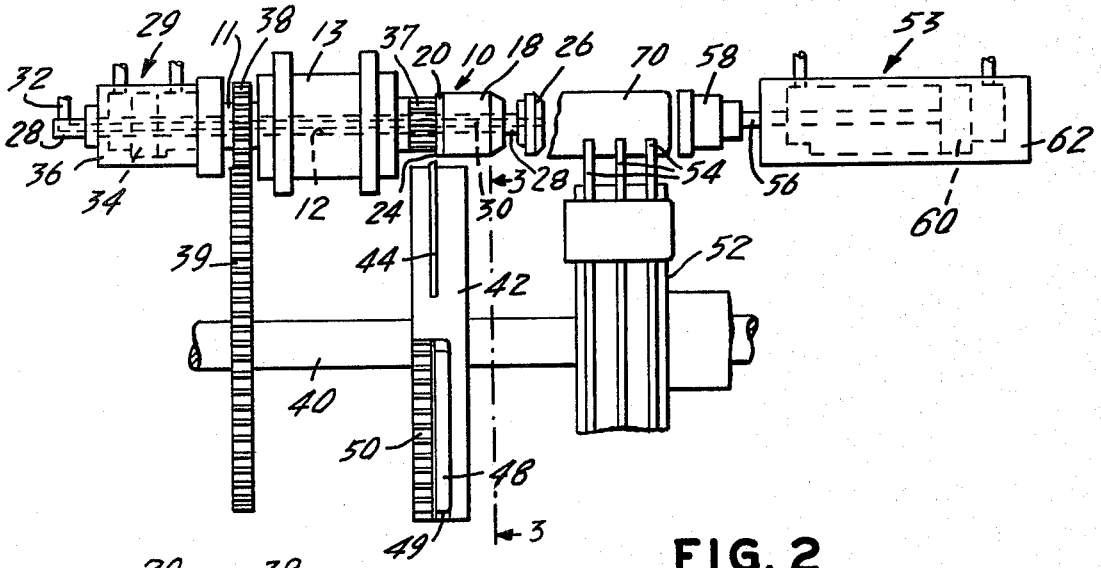
FIG. 1 is a fragmentary, elevational view of trimming and deburring apparatus embodying the present invention, and showing an untrimmed can shell prior to loading onto the mandrel assembly.

Turning now in detail to the appended drawing, therein illustrated is a trimming and deburring apparatus embodying the present invention, including a mandrel assembly, generally designated by the numeral 10. The mandrel assembly 10 includes a spindle 11, which is rotatably mounted within a bearing housing 13 (supported on a base by appropriate means, neither of which is shown), and carries a cylindrical mandrel member 18 at one end, a driven pinion 38 at the opposite end, a serrated cylindrical portion 37 adjacent the housing 13, and a work disc 20 interposed between the serrated portion 37 and the mandrel member 18. The disc 20 has a relatively smooth, cylindrical outer surface, and a sharp edge 24 at the end remote from the mandrel member 18.

Extending through the spindle 11 is an axial passageway 12, in which is received the rod 28 of a piston sub-assembly, generally designated by the numeral 29. Mounted on the forward end of the rod 28 is a generally cylindrical push member 26; the opposite end of the piston rod 28 is disposed within the cylinder 36 of a pneumatic unit supported adjacent the bearing housing 13 (by means not shown), and carries a piston head 34. As will readily appreciated, control of the position of the head 34 within the cylinder 36 is achieved by the introduction and withdrawal of air into and from the cylinder 36, in turn effecting axial movement of the push member 26 (for a purpose to be explained in detail hereinafter). The piston rod 28 also has a small bore 30 extending through it, and a hose 32 coupled to its rearward end provides communication with a source (not shown) of compressed air.

Mounted, by means not shown, adjacent the portions of the apparatus hereinbefore described is a shaft 40 which rotates about an axis parallel to that of the spindle 11. The shaft 40 has supported on it a multi-pocketed can carrying turret 52, and affixed to it a drive gear 39, in meshing engagement with the pinion 38 on the spindle 11, and a tool carrier wheel 42 disposed between the turret 52 and the gear 39. Mounted on the wheel 42 are a cutting tool sector 44, having a relatively sharp edge 46, an ironing tool sector 48, having a cylindrical surface position 49, and a corrugated scrap knurling sector 50.

The apparatus illustrated also includes a loading mechanism, generally designated by the numeral 53, consisting of a hydraulically-operated cylinder 62, in which is mounted a piston rod 56 having a piston head 60 at one end and a loading chuck 58 affixed to the opposite end thereof. As will be clear, the introduction and withdrawal of hydraulic fluid into the cylinder 62 causes axial movement of the head 60, which in turn effects reciprocation of the chuck 58.

Figure 2:
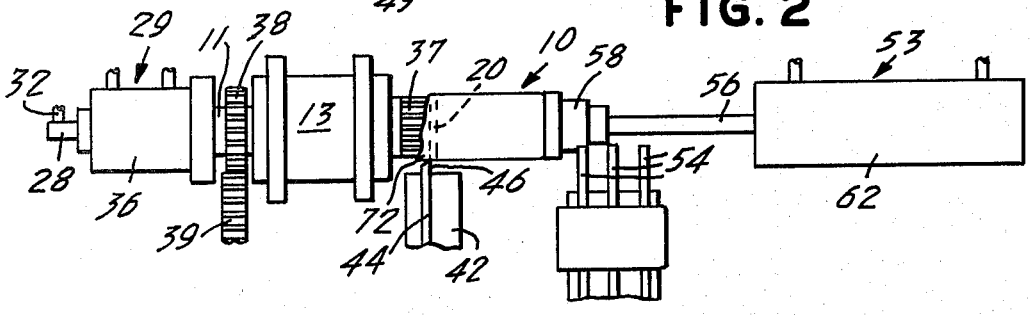
FIG. 2 is a view similar to that of FIG. 1, with portions removed and showing a phase of operation in which the untrimmed can shell is loaded onto the mandrel assembly.

In operation, an untrimmed can shell or body 70, supported in a pocket provided by the cradle elements 54 of the turret 52, is presented thereby into axial alignment between the mandrel assembly 10 and the loading mechanism 53. Thereupon, hydraulic fluid is introduced into the cylinder 62, moving the piston head 60, and in turn the chuck 58, from the position shown in FIG. 1 to that shown in FIG. 2. In so doing, the chuck transfers the can shell 70 from the underlying carriage elements 54 of the turret 52 onto the mandrel assembly 10 and, in particular, the mandrel member 18 and push member 26 thereof, with the uneven edge portion 72 thereof extending beyond the cutting edge 24 of the disc 20.

Figure 4:
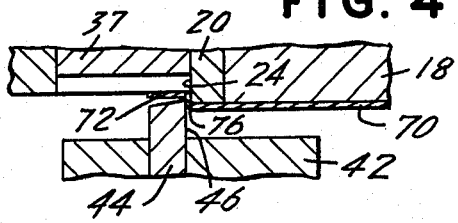
FIG. 4 is an enlarged, fragmentary view of thee apparatus, showing the cutting elements in operation.
Figure 3:
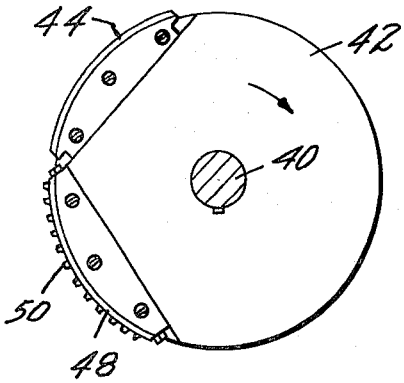
FIG. 3 is an end view of the tool-supporting wheel used in the apparatus of the foregoing figures, taken along line 3—3 of FIG. 1.

Rotation of the drive gear 39 by an electric motor (not shown) synchronously rotates the shaft 40 and the spindle 11, the latter rotating at a higher speed due to the smaller diameter of the driven pinion 38. While the shell 70 is thus being rotated on the mandrel assembly 10, rotation of the wheel 42 on the shaft 40 brings the cutting tool 44 into coaction with the relatively sharp edge 24 of the work disc 20 (as is best seen in FIG. 4), with the edge 46 of the tool 44 cooperating with the edge 24 to shear the irregular edge portion 72 of the shell 70 from the remainder thereof; in so doing, it produces an internal burr 76.

Figure 5:
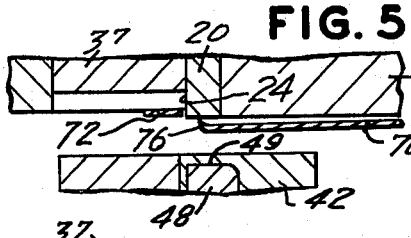
FIG. 5 is a view similar to that of FIG. 4, showing the can body shifted on the body-support means, with the burr portion positioned for ironing.
Figure 6:
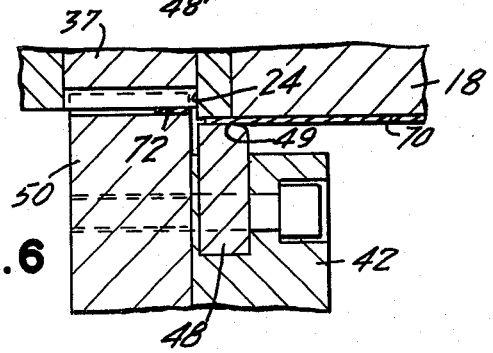
FIG. 6 is a view comparable to that of FIGS. 4 and 5, showing the ironing elements in operation.

Following trimming of the edge portion 72, the piston sub-assembly 29 is pneumatically driven forwardly a short distance by the introduction of air into the cylinder 36. This shifts the shell 70 slightly on the mandrel assembly 10, and thereby positions the burr 76 on the cylindrical surface of the working disc 20; these relationships are shown in FIG. 5.

Further rotation of the wheel 42 thereafter brings the ironing tool 48 into coaction with the working disc 20, flattening the edge of the shell 70 between the respective surfaces thereof, causing the burr 76 to fracture, and thereby to become detached from the shell 70. Simultaneously, the knurling sector 50 meshes with the corrugated portion 36 of the mandrel assembly 10, thereby corrugating the scrap edge 72 severed in the cutting operation, and ensuring its discharge from the apparatus. At the completion of these operations while the loading chuck 58 is retracted, compressed air is injected into the hose 32 through the bore 30, building up pressure within the shell 70 to blow it from the mandrel assembly 10 and return it to the cradle elements 54 of the turret 52. Thereupon, the turret 52 indexes the trimmed and deburred shell away from the work station and into a discharge chute (not shown), and presents a raw shell, disposed in an adjacent pocket, thereto.

It should be noted that some of the components of the instant apparatus may be substantially the same as those disclosed in U.S. Pat. No. 3,714,854, and that much of the auxiliary apparatus described therein may be used with the apparatus of this invention; accordingly, the disclsoure of the subject patent is incorporated herein by reference. In view thereof, only those components of the instant apparatus which are specific to the inventive concept have been described in detail. In addition, it should be appreciated that the operation and proper sequencing of the various components of the apparatus may be effected in a variety of ways well known in the art, i.e., by systems utilizing mechanical, pneumatic, hydraulic and/or electrical activation and control mechanisms, as is suggested and described in the aforementioned patent.

While the instant method and apparatus have been described in relation to the illustrated and preferred embodiment, it should be understood that modifications may be made, as will be apparent to those skilled in the art. For example, the function of the work disc which, in the illustrated apparatus, cooperates in both the severing and also the deburring operations, may be performed by other parts of the support means, which may be provided solely by a mandrel, or may include separate elements to perform each of the required functions. In addition, while it is preferred that the body be shifted axially on the support means pneumatically, this may be accomplished by other equivalent means known in the art. Finally, while it is possible that neither of the support means nor operating tools need be rotatable, generally one will be rotatable, and preferably both will rotate.

Thus, it can be seen that the instant invention provides a novel method and apparatus for trimming cylindrical metal bodies and for removing internal burrs which result from the trimming operation; a method and apparatus which are simple, efficient and convenient to use, and are adapted to economical, high-speed operation. It also provides a novel method and apparatus which are especially suitable for the production of container shells by draw-redraw and drawing and ironing techniques and, in particular, can shells produced from aluminum or steel blanks.

What is claimed is:

1. Apparatus for trimming and deburring the edges of cylindrical metal bodies, comprising:

support means upon which a cylindrical metal body may be mounted, said support means including a cutting element and a cylindrical portion;

a cutting tool disposed adjacent said cutting element and being adapted to cooperate therewith to sever an edge portion of a metal body mounted on said support means, and to form an inwardly-directed burr at the newly-formed edge of the body;

an ironing tool disposed adjacent said cylindrical portion of said support means and being adapted to cooperate therewith to iron a portion of a metal body disposed thereon; and means for controllably shifting a metal body axially on said support means to move a portion of the body from said cutting element to a position on said cylindrical portion of said support means, so that, following severance and internal burr formation, the burr-bearing portion of the body may be moved to said cylindrical portion of said support means, to permit ironing of the burr thereat, and to thereby effect its fracture and removal.

2. The apparatus of claim 1 wherein said support means is rotatable.

3. The apparatus of claim 2 wherein said support means includes a substantially cylindrical mandrel axially adjacent said cylindrical portion thereof, and wherein said cylindrical portion has a relatively sharp edge which is spaced axially from said mandrel, and which serves as said cutting element.

4. The apparatus of claim 1 additionally including a rotatably mounted support member, said cutting tool and said ironing tool being mounted at peripherally- and axially-spaced locations on said support member.

5. The apparatus of claim 4 wherein said support member comprises a wheel.

6. The apparatus of claim 4 wherein said support means is mounted on a first shaft and said support member is mounted on a second shaft, said shafts being rotatable on substantially parallel axes, and being interconnected to afford synchronized rotation of said support means and support member.

7. A method for trimming and deburring the edges of cylindrical metal bodies, comprising the steps of:

mounting a cylindrical metal body on support means having a cylindrical portion;

severing an edge portion from the body so as to form an inwardly-directed burr at the newly-formed edge thereof;

shifting the body axially on the support means to move the burr-bearing edge thereof onto said cylindrical portion thereof; and ironing the burr against the surface of the cylindrical portion to effect its fracture and removal from the remainder of the body.

8. The method of claim 7 which additionally includes the step of rotating the body while performing said severing and ironing steps.

9. The method of claim 7 wherein the body is the shell for a drawn and ironed or draw-redraw container.

* * * * *